US005844156A

United States Patent [19]

Nagahara

[11] Patent Number: 5,844,156

[45] Date of Patent: Dec. 1, 1998

[54] HEAD JOINT FOR A FLUTE

[76] Inventor: Kanichi Nagahara, 32 Wild Rose Dr., Andover, Mass. 01810

[21] Appl. No.: 852,997

[22] Filed: May 8, 1997

[51] Int. Cl.[6] ..... G10D 7/02

[52] U.S. Cl. ..... 84/384

[58] Field of Search ..... 84/384

[56] References Cited

U.S. PATENT DOCUMENTS 3,062,084 11/1962 Ogilume ..... 84/384

5,105,705 4/1992 Drelinger ..... 84/384

*Primary Examiner*—William M. Shoop, Jr.

*Assistant Examiner*—Shih-Yung Hsigh

*Attorney, Agent, or Firm*—Scott B. Garrison; Lamber & Garrison PLLC

[57] ABSTRACT

A flute head joint in which the riser contains a gold blowing edge or blowing edge of any other suitable material. This eliminates the need to provide for a 360 degree precisely matched interface between the lip plate and the riser while providing the advantages associated with the use of a "gold-ring" style head joint assembly. The blowing edge is formed by a protrusion which enters upwardly into and is made coplanar or commensurate with the topmost surface of the lip plate. The riser is soldered or otherwise mated in intimate communication around its entire perimeter. It has been found that this head joint significantly reduces material and labor costs while not having any significant impact on tone relative to the "gold-ring" style head joint.

6 Claims, 3 Drawing Sheets

HEAD JOINT FOR A FLUTE

BACKGROUND OF THE INVENTION

The present invention relates to the field of musical instruments. More particularly, it relates to an improved head joint for flutes and head joints for flute type instruments. In this specification the term flute shall refer to thin-wall flute type instruments including flutes and piccolos, as well as flutes and piccolos which are hybrids between thin-wall and historic wall instruments. A flute head joint comprises four principal parts: the tube, or one portion of the flute body itself; a lip plate upon which the player's lip rests while playing the flute; a riser or chimney which separates the lip plate from the head joint tube; and a crown assembly which seals one end of the tube.

The head joint of a flute has a critical effect on the performance of the instrument. Even though the head joint is mechanically simple, it is an acoustically active body which can determine, and limit, the performance of the flute. Traditionally, head joints were constructed of like materials, for example, all gold or all silver. Flute makers or manufacturers as well as players soon realized that subtle differences in tonal quality or color could be obtained by combining parts of dissimilar metals. A popular option today is to combine a silver head joint tube with a gold lip plate and gold riser. While this results in a marked difference in tone, it also adds considerably to the material cost of the head joint.

A less costly option, and one to which this invention relates, is to construct the head joint from a silver tube and silver lip plate with a gold riser. However as a player blows across the lip plate, vibration of the edge of the lip plate or the blowing edge is responsible for the sound. By utilizing a silver lip plate, the tonal change is not as great as that of the more expensive gold lip plate and is therefore considered significantly inferior to the gold lip plate One method of construction designed to more closely approximate the sound of the gold lip plate while minimizing material costs is to extend the riser up through the plane of the lip plate so that a ring of gold extends 360 degrees around the blowing hole. This is referred to a the "gold ring" type head joint. While the material costs for this head joint are significantly less than the gold riser and gold lip plate version, the nature of this lip plate makes it very difficult to fit properly with respect to the riser. Consequently, the labor costs associated with the production of the "gold ring" type head joint add considerably to the final price. This increase in production cost reduces the advantage gained over the price of a gold lip plate and gold riser configuration.

To construct a basic head joint, the following steps are commonly employed. A rough hole is first cut into the lip plate. Next a riser is soldered to the lip plate in a position which most accurately aligns the lip plate hole with the riser hole. The combination of the lip plate and riser are then soldered to the tube itself. The final step is to finish the lip plate hole and the internal surface of the riser to specification.

Creation of the "gold ring" type design is more difficult and time consuming because the interface between the lip plate and the riser must be matched prior to soldering. This is an especially arduous task due to the curvature and angles found over the entire interface between the lip plate and the riser. Since the entire interface between the two components must be made to fit precisely, and a match over the entire 360 degrees of the joint is difficult, a greater amount of solder is often utilized to bridge gaps between the lip plate and the riser. The additional quantity of solder to bridge these gaps increases the likelihood of the solder joint containing pits or bubbles, thus ultimately weakening the solder joint and also possibly affecting tone of the instrument.

SUMMARY OF THE INVENTION

What is needed is a new and improved head joint design which will provide a player with the advantages of a gold lip plate at a fraction of the cost while also providing the manufacturer with an easily assembled configuration thereby reducing the cost associated with the time and labor needed for assembly. The inventor has developed such a head joint. This new head joint provides a riser containing a gold blowing edge without the former difficulties associated with the "gold ring" type design or resorting to the cost of a gold lip plate.

The means by which the inventor has eliminated the deficiencies of the "gold ring" type design is to eliminate the need for the 360 degree precisely matched interface between the lip plate and the riser. The inventor has found that no significant loss in tonal quality results by limiting the pre-soldered matched interface to only a portion of the lip plate and the riser. In other words, rather than providing a gold ring which is made to protrude into the plane of the lip plate, the inventor has limited the protrusion to no more than a single edge or lip at the blowing edge. This single lip or step protrudes upward from the riser into and coplanar with the topmost surface of the lip plate and is soldered or otherwise mated in intimate communication therewith. The remainder of the riser is below, i.e., does not protrude into the lip plate and as such is soldered under the same techniques used in the more traditional riser configuration.

One advantage of this configuration is that it requires a precise pre-soldered fit only along that edge of the interface between the lip plate and riser comprising the lip itself. As discussed above, the remainder of the riser can be soldered to the lip plate by traditional techniques. Another added advantage of the present invention is that the lip actually serves as a guide to enable accurate placement of the riser with respect to the lip plate.

Therefore it is an object of the present invention to provide a new and improved riser which can be accurately aligned and mated with a lip plate in a flute.

It is another object of the present invention to provide the advantages in tonal quality associated with the use of gold in a lip plate and riser combination without the requisite costs associated with the traditional approach of using gold for both components or the manufacturing difficulties associated with the "gold ring" type design.

BRIEF DESCRIPTION OF THE DRAWINGS

The novel features considered characteristic of the invention are set forth in the appended claims. The invention itself, however, both as to its construction and its method of operation, together with additional objects, features and advantages thereof, will best be understood from the following description of the specific embodiments when read and understood in connection with the accompanying drawings.

DETAILED DESCRIPTION OF THE PREFERRED EMBODIMENT

Figure 3:
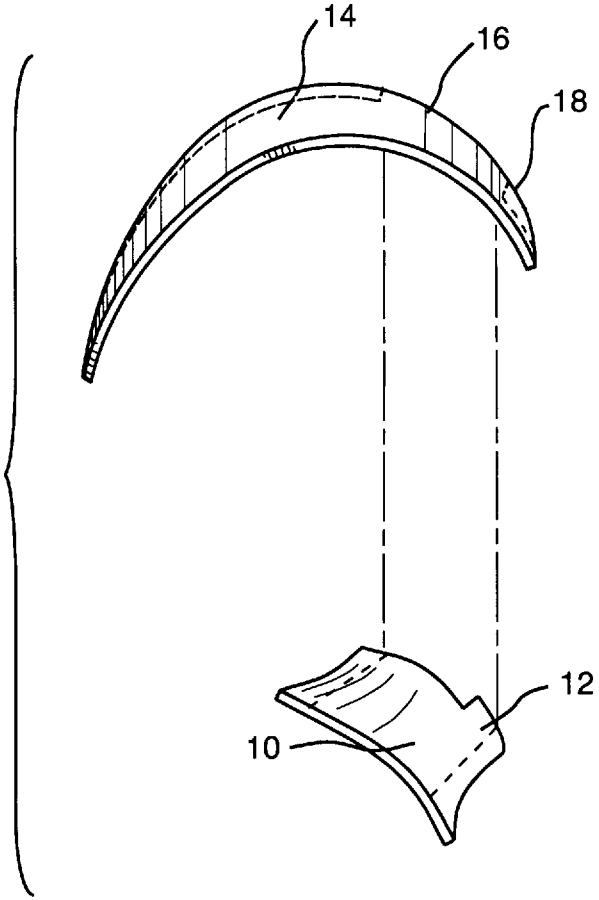
FIG. 3 is a side elevation exploded view of the FIG. 1 riser and FIG. 2 lip plate depicting how they mate and also showing the protrusion on the riser.
Figure 1:
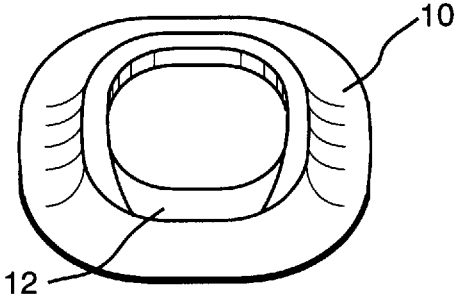
FIG. 1 is a top plan view of a riser for use in a flute according to one preferred embodiment of the present invention.

Referring to FIGS. 1 and 3, a preferred embodiment of a riser for use in a flute referred to in its entirety by reference numeral 10 is depicted. The riser 10 is similar to a standard head joint riser for use on flutes with the exception of the addition of a lip or protrusion 12 which protrudes upwardly from one side of the topmost edge of the riser 10. The protrusion 12 should be made to extend from no less than 90 degrees and no greater than 180 degrees around the perimeter of the topmost edge of the riser 10, with a preferred value of 120 degrees. The tradeoff being that acoustics could be affected as the protrusion 12 is made smaller whereas as the protrusion is made larger the disadvantages associated with the "gold ring" type riser develop.

Since the main purpose for adding the protrusion 12 is to reduce the costs of manufacturing a gold lip plate and riser, it is desired that at the very least the protrusion 12 be made of a material selected to produce the desired tonal response, for instance one such material being gold. However, in the Applicant's preferred embodiment, the entire riser 10 comprises the selected material. As stated any other material desired by the flute maker or the flute player could be used for the protrusion 12, such as silver, platinum, precious metal alloy, or other; but the tone would be affected by a substitution of materials.

Figure 2:
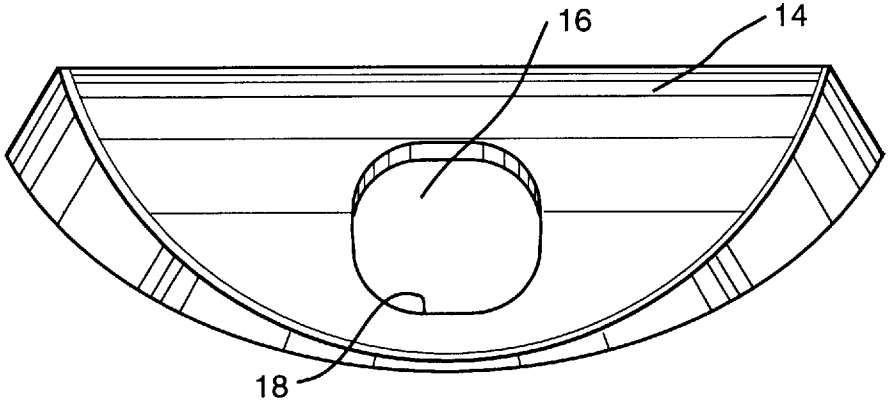
FIG. 2 is a top plan view offset toward the front of a lip plate according to one preferred embodiment of the present invention within which the FIG. 1 riser mates.
Figure 4:
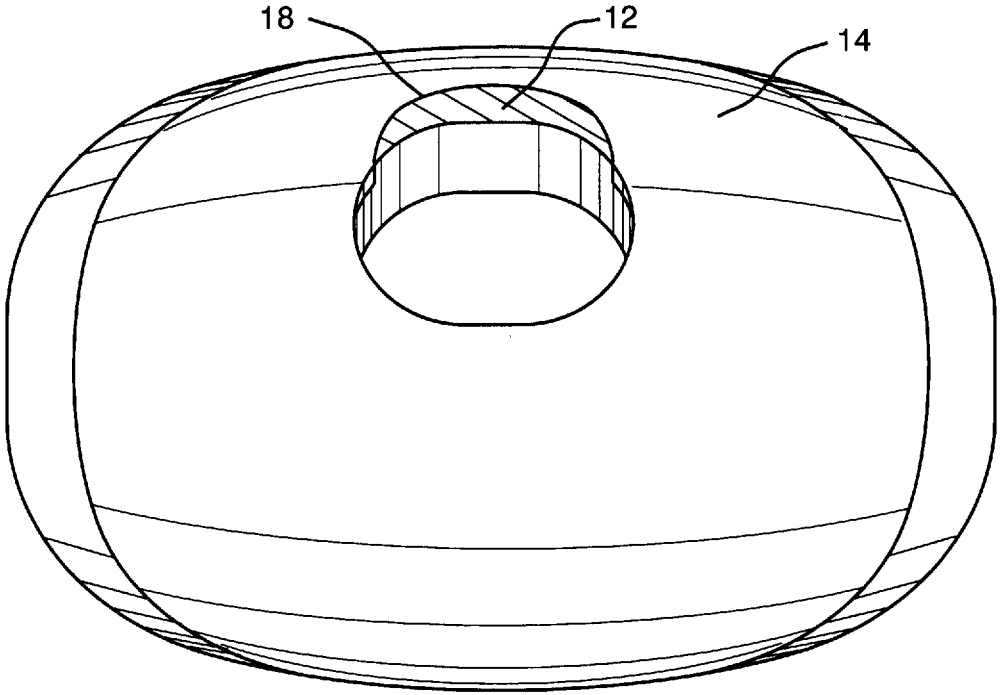
FIG. 4 is top plan view of the FIG. 1 riser and FIG. 2 lip plate assembled wherein the lined area depicts the protrusion of the FIG. 1 riser engaged with the recess of the FIG. 2 lip plate.
Figure 5:
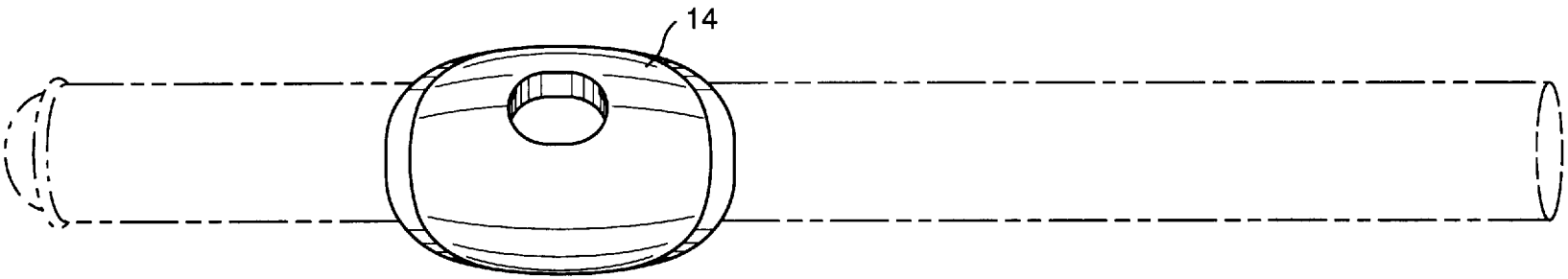
FIG. 5 is a flute head joint containing the invention.

FIG. 2 depicts a lip plate 14. As depicted especially in FIG. 3, the riser 10 is next made to seat underneath the lip plate 14 in the conventional manner, with the exception that protrusion 12 is made to protrude upward through a blow hole 16. In a standard flute, the blowing edge is best defined as the intersection of the horizontal plane of the lip plate 14 with the vertical plane of the riser 10. This edge occurs at the front of the blow hole 16. Although the two planes are not necessarily truly horizontal nor truly vertical, the concept is understood in the art. This intersection, however, does not form the blowing edge in the present invention. As depicted in FIG. 4, in the present invention, this intersection is referred to as simply the front edge 18 as it really is no more than the front edge of the blow hole 16. Since the protrusion 12 of the riser 10 extends upward into the blow hole 16, it is the horizontal and vertical intersecting planes of the protrusion itself which effectively meet to form the blowing edge. Protrusion 12 is of a height necessary to be commensurate or coplanar with a topmost surface of said lip plate 14. Since only the protrusion 12 extends into the lip plate 14, it is correspondingly easier to ensure that the interface between the protrusion 12 and the edge of the lip plate at the front edge 18 of the blow hole 16 fit tightly. Once the riser 10 is properly situated as described above, the entire riser is soldered to the lip plate by conventional means and this assembly is soldered to the tube creating the FIG. 5 head joint While the invention has been described and illustrated with reference to this specific embodiment, it is understood that the use of this embodiment or other embodiments, may be resorted to without departing from the invention. Therefore the form of the invention set out above should be considered illustrative and not as limiting the scope of the following claims.

What is claimed is:

1. A flute head joint comprising:

a tubular head joint portion having a closed end and an open end;

a lip plate having an upper surface for defining a lip rest surface, a lower surface, and a hole therebetween; and a riser disposed along an outer side edge of said tubular head joint portion; said riser having a lower edge, an upper edge, and a protrusion on said upper edge; wherein said lower edge is permanently affixed to said tubular head joint portion and wherein said upper edge other than that portion comprising said protrusion is permanently affixed to said lower surface of said lip plate, and said protrusion is extended upwardly into said lip plate hole and permanently affixed at an outer side to a front edge of said hole and wherein said protrusion is of sufficient length so that said protrusion extends into said lip plate to a point where a topmost edge of said protrusion is both coplanar with said upper surface of said lip plate at said front edge of said hole and in intimate contact with said front edge of said hole along the entire interface between said protrusion and said lip plate.

2. A flute head joint in accordance with claim 1 wherein said interface between said protrusion and said front edge of said hole ranges from no less than 90 degrees to no more than 180 degrees around perimeter of said hole.

3. A flute head joint in accordance with claim 2 wherein said interface between said protrusion and said front edge of said hole extends 120 degrees around perimeter of said hole.

4. A flute head joint in accordance with claim 3 wherein said riser comprises material containing at least some precious metal.

5. A flute head joint comprising:

a tubular head joint portion;

a lip plate having an upper surface, a lower surface, and a bore disposed therein from said upper to said lower surface, said upper surface defining a lip rest surface upon one side of said bore and an opposite surface disposed across said bore on the upper surface opposite said lip rest surface; and a riser having a lower edge permanently affixed to said tubular head joint portion, and an upper edge, said upper edge further having a protrusion extending therefrom;

wherein said protrusion is fitted within said lip plate bore and permanently affixed along an external side portion to that edge of said bore defining said opposite surface;

wherein the uppermost edge of said protrusion when affixed to said edge of said bore is coplanar with the upper surface of said lip plate at said opposite surface and that side of said protrusion internal to said bore forms a blowing edge for conveying a vibration to said flute which manifests as a tone; and wherein the remainder of said upper edge of said riser is permanently affixed to the lower surface of said lip plate.

6. In a head joint of claim 5, said riser further comprising at least one precious metal.

* * * * *